US010035624B2

(12) United States Patent
Bauss

(10) Patent No.: US 10,035,624 B2
(45) Date of Patent: Jul. 31, 2018

(54) CLOSURE ELEMENT FOR A RECEPTACLE

(71) Applicant: Schreiner Group GmbH & Co. KG, Oberschleissheim (DE)

(72) Inventor: Markus Bauss, Lengdorf (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 802 days.

(21) Appl. No.: 14/399,583

(22) PCT Filed: May 8, 2013

(86) PCT No.: PCT/EP2013/059669

§ 371 (c)(1),
(2) Date: Nov. 7, 2014

(87) PCT Pub. No.: WO2013/167701

PCT Pub. Date: Nov. 14, 2013

(65) Prior Publication Data

US 2015/0090625 A1 Apr. 2, 2015

(30) Foreign Application Priority Data

May 9, 2012 (DE) ..... 10 2012 104 062
Dec. 14, 2012 (DE) ..... 10 2012 112 297

(51) Int. Cl.
*B65D 23/08* (2006.01)
*B65D 25/20* (2006.01)
(Continued)

(52) U.S. Cl.
CPC ..... *B65D 25/205* (2013.01); *B65D 23/08* (2013.01); *B65D 23/085* (2013.01); *B65D 41/62* (2013.01);
(Continued)

(58) Field of Classification Search
CPC ..... B65D 23/08; B65D 23/085; B65D 41/62; B65D 25/205
(Continued)

(56) References Cited

U.S. PATENT DOCUMENTS 2,261,875 A * 11/1941 Dunn ..... B65D 55/0854 215/246
2,977,014 A 3/1961 Kock
(Continued)

FOREIGN PATENT DOCUMENTS

CH 598 059 A5 4/1978
CN 1119009 A 3/1996
(Continued)

OTHER PUBLICATIONS

International Search Report of PCT/EP2013/059669, dated Aug. 16, 2013.

*Primary Examiner* — King M Chu
(74) *Attorney, Agent, or Firm* — Collard & Roe, P.C.

(57) ABSTRACT

Disclosed is a closure element for a receptacle (40) holding a pharmaceutical content, comprising:

Figure 1:
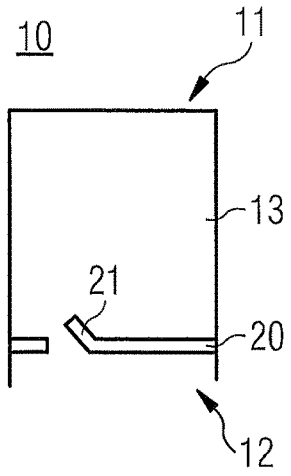

a closure capsule (10) comprising a lateral area (13), a closed end and an open end, a tear strip comprising a grip tab for opening the closure capsule (10) and a closure label (30) comprising a web-shaped substrate which has a lower side provided with an adhesive;

wherein the closure capsule (10) is arranged on the receptacle (40) in such a way that the closure capsule (10) covers an opening (41) of the receptacle (40), and wherein a first subarea (38) of the label (30) is arranged on the receptacle (40) and a second subarea (39) of the label (30) is arranged
(Continued)

on the closure capsule (10) and the tear strip in such a way that the grip tab of the tear strip is not covered by the label (30).

44 Claims, 12 Drawing Sheets

(51) Int. Cl.
*B65D 41/62* (2006.01)
*B65D 55/08* (2006.01)

(52) U.S. Cl.
CPC ..... *B65D 55/0818* (2013.01); *B65D 2203/10* (2013.01)

(58) Field of Classification Search
USPC ..... 206/459.5, 807; 215/206, 200, 254, 250; 283/100
See application file for complete search history.

(56) References Cited

U.S. PATENT DOCUMENTS 3,873,018 A * 3/1975 Donnay ..... B65B 7/2864 156/187
4,758,456 A * 7/1988 Muscala ..... B65D 55/0854 215/232
5,145,065 A * 9/1992 Mizutani ..... B65D 3/22 206/389
5,217,307 A 6/1993 McClintock
5,741,242 A 4/1998 Kriesel
6,254,139 B1 * 7/2001 Fresnel ..... B65D 55/026 283/72
6,908,113 B2 * 6/2005 Chaduc ..... G09F 3/0292 206/459.5
2004/0060892 A1 4/2004 Heston et al.
2005/0162277 A1 * 7/2005 Teplitxky ..... B65D 55/06 340/572.8
2005/0242957 A1 11/2005 Lindsay et al.
2005/0284941 A1 12/2005 Lubow
2007/0139205 A1 6/2007 Tanaka et al.
2008/0061153 A1 * 3/2008 Hickle ..... A61M 16/183 235/492
2009/0057183 A1 * 3/2009 Benavides ..... A61J 1/035 206/531
2010/0084364 A1 * 4/2010 Martin ..... B65D 41/34 215/201
2010/0326868 A1 12/2010 McClain et al.

FOREIGN PATENT DOCUMENTS

CN 1298360 A 6/2001
CN 2505436 Y 8/2002
CN 201074078 Y 6/2008
CN 201892956 U 7/2011
DE 697 04 495 T2 9/2001
EP 0 929 886 B1 7/1999
EP 1 044 698 A1 10/2000
FR 2 158 069 A1 6/1973
FR 2 271 994 A 12/1975
GB 275 491 A 8/1927
GB 1 530 158 A 10/1978
GB 2 140 786 A 12/1984
WO 94/18087 A1 8/1994
WO 98/15939 A1 4/1998

* cited by examiner

CLOSURE ELEMENT FOR A RECEPTACLE

CROSS REFERENCE TO RELATED APPLICATIONS

This application is the National Stage of PCT/EP2013/059669 filed on May 8, 2013, which claims priority under 35 U.S.C. § 119 of German Application Nos. 10 2012 104 062.1 filed on May 9, 2012, and 10 2012 112 297.0 filed on Dec. 14, 2012, the disclosures of which are incorporated by reference. The international application under PCT article 21(2) was not published in English.

The present invention relates to a closure element for a receptacle holding a pharmaceutical content.

High-quality products require large efforts in terms of development and manufacture as well as correspondingly high-priced raw materials for production. This is why such high-end products usually are very expensive.

Due to the high selling prices of these high-end products, an increasing number of sub-standard fake products are produced and sold in addition to the original products which are manufactured in a relatively complex manner. Here, the fake products of minor value are not always marked as such. In order to achieve a profit which is as high as possible, one tries to create the impression that the low-grade fake products are original products. On the one hand, the low-grade fake products are offered in packaging of deceptively similar appearance. On the other hand, attempts are made to acquire the original packaging and to put the low-grade fake products on the market in this original packaging.

In many cases, the original packaging does not offer an indicator of having been opened for the first time (tamper-evidence protection). Thus, it is possible to open the original packaging, to remove the original content and to replace it by a low-grade fake product without this fact being apparent to future users.

In order to acquire the original packaging, it also may be that already used, discarded packaging is utilized which does not have an effective tamper-evidence protection. Such packaging originally comes from the production of a genuine manufacturer. This is why a potential buyer has few criteria for realizing that the refilled original packaging is a packaging comprising a counterfeit content.

Thus, a person who buys an original packaging which has been refilled afterwards will not be able to discern that it is not an original product. Only after unpacking or during use of the low-grade product, the buyer will realize the damage involved. However, as the buyer supposes due to the original packaging that it is a product of the original manufacturer, he will attribute the related harm indeed to the original manufacturer.

What is more, the use of such original packaging makes it difficult to detect—even for the manufacturer—that it really is a low-grade fake product. In the worst case, the original manufacturer may be held accountable for the damage to a user due to the low-grade fake product.

This is why the manufacturers of high-quality products are anxious to put a buyer into the position of being able to readily see if it really is a high-end original product or a fake product of low-grade quality.

Such high-end original products, as already mentioned initially, are for instance medical engineering products such as implants, prostheses, ortheses, auto-injectors or pens for administering liquid medication, pharmaceutical products such as medicinal drugs, or syringes prefilled with liquid medicaments, but also lipsticks, cigarettes and cigars, cosmetic products such as perfumes, food products, beverages such as champagne or whiskey or even spare parts for machines, motor vehicles or airplanes.

In particular in the case of pharmaceutical products, for instance medicinal drugs, there is—apart from the damage to the manufacturer's image—a large risk for the patient who is to receive such a medication. A refilled packaging for a pharmaceutical product may contain, for instance, a substance without any effect. In this case, a patient would not receive the medication which may be urgently needed. It would be far worse if another substance, say a contaminated or even hazardous one was administered instead of the intended medication. In this case, the patient may be injured to a substantial extent.

For this reason, especially the manufacturers of medical drugs and other pharmaceutical products are anxious to offer the possibility to be able to see at all times whether the packaging holds the high-class original product or is a refilled packaging.

To this end, the opening of a drug bottle may be fitted with a plastic capsule, for instance, as on beverage bottles. Such plastic capsules usually are made of a material which contracts under the influence of heat and in this way fits more closely to the bottle opening and the bottleneck. For opening, said plastic capsule usually has to be torn open. In doing so, the capsule is mechanically destroyed and cannot be used again.

This approach, however, has the disadvantage that any other markings on the bottle, such as the additionally affixed labels, are still intact. This is why a counterfeiter only needs to acquire new capsules for the bottleneck. In this way, the emptied bottle could be refilled with any substance and would be deceptively similar to the original after having attached a new capsule.

Furthermore, it may happen in many instances that the original capsule can be pulled off from the opening in a non-destructive manner. In this case, it is possible to take out the high-end original substance, to replace it by any other, low-grade substance and then to attach the original closure capsule again.

In order to create a closure capsule which has a very snug fit, a capsule is normally used which shrinks under the influence of heat, i.e. contracts under exposure to heat, so that its diameter is reduced. As pharmaceutical products are very sensitive to heat usually, the content could be damaged during shrinking such a capsule. This is why the sealing of pharmaceutical receptacles with such shrinking foils is normally not possible.

It is therefore the object of the invention to provide a closure element which is suitable for a receptacle holding a pharmaceutical content, whereby the receptacle can be closed such that the initial opening of the receptacle can be undoubtedly detected and proven. Having opened it for the first time, repeatedly reclosing the receptacle shall not be possible at all or only with visible traces indicating the initial opening.

In order to achieve this object, a closure element provided for a receptacle comprising a pharmaceutical content is suggested, comprising a closure capsule, a tear strip and a closure label. The closure capsule preferably comprises a lateral area, a closed end and an open end. The tear strip comprises a grip tab for opening the closure capsule. The closure label comprises a web-shaped substrate which is provided with an adhesive on a lower side. The closure capsule is arranged on the receptacle such that the closure capsule covers an opening of the receptacle. A first subarea of the label is arranged on the receptacle and a second subarea of the label is arranged on the closure capsule and/or on the tear strip in such a manner that the grip tab of the tear strip is not covered by the label, i.e. is exposed and hence can be easily grasped by hand and pulled away.

In a special embodiment, the closure capsule of the closure element is rotationally symmetrical. Such closure capsules are especially well suited for closing the receptacles described above, as these receptacles usually have an approximately round opening area.

Here, the tear strip may extend radially along the lateral area of the closure capsule, i.e. (in azimuthal fashion) along the circumferential direction of the lateral area; i.e. in the horizontal when the receptacle is stored in an upright position. Thus, pulling the tear strip permits opening the closure element all around.

Alternatively, the tear strip may also extend parallel to a cylinder axis of the rotationally symmetrical closure capsule, i.e. along an axial direction. In this case, pulling the tear strip opens the closure capsule from the top to the bottom, or vice versa.

Alternatively, the tear strip may axially extend from the top or the bottom up to the middle (or to any other height) of the closure capsule and continue from there horizontally along the circumferential direction of the lateral area.

The tear strip may be designed to be part of the closure capsule. In this way, it is not necessary to produce an additional material element in a separate working step. By way of example, the tear strip may be divided or delimited with respect to the remaining closure capsule by one or more perforations or punched zones, but otherwise be integrally connected to it.

Alternatively, the tear strip may also be implemented as a separate part. In this case, a previous processing of the closure capsule in a further working step is not required. In addition, there is the option to produce the tear strip from a particularly robust and tear-proof material.

In a special embodiment, the label comprises an additional material layer having a predetermined thickness. Said thickness of the additional material layer preferably corresponds approximately to the thickness of the lateral area of the closure capsule. In this way, it is possible to attach the label on the closure element and the receptacle in such a manner that a crease-free application is made possible.

In a special embodiment, the closure element comprises a label including punched safety features. Such punched safety features have the effect that—during an attempt to detach the label—the latter is particularly prone to tearing and hence is destroyed. Any further use is not possible any more thereafter.

A closure element described above may be attached to a receptacle comprising a pharmaceutical content. In this way, such a receptacle is reliably protected against manipulation, in particular against a non-authorized further use, as the closure element is irreversibly destroyed during opening the receptacle for the first time.

A receptacle of this type may be, for instance, a bottle comprising a bottleneck and a bottle body, the label being attached to the bottleneck. Alternatively, the label may also be fastened to the bottle body. In this case, the bottleneck is completely surrounded by the closure capsule. The receptacle containing a pharmaceutical liquid or provided therefore may have any shape and designated use; it may be an injection syringe, for instance.

In all embodiments of the present application, identification features, in particular an RFID chip (plus antenna) or a visual ID code may be provided; in this respect, reference is made to the description of the drawings and to the claims.

Figure 2:
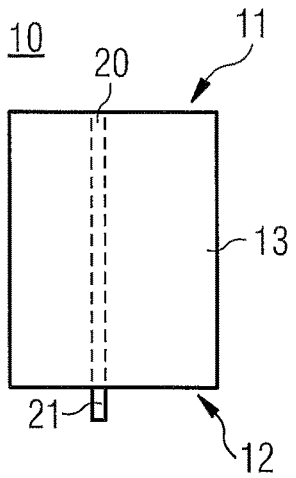
Figure 4:
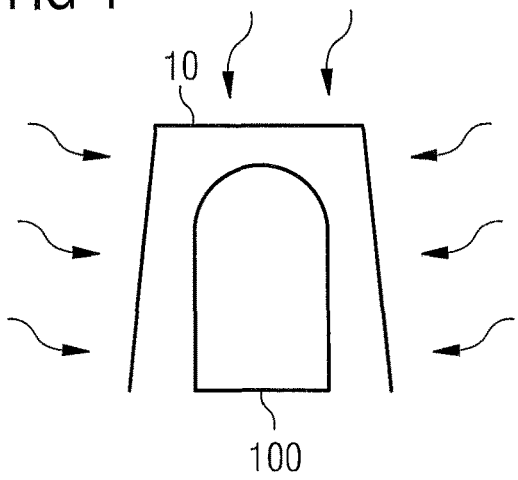
Figure 5:
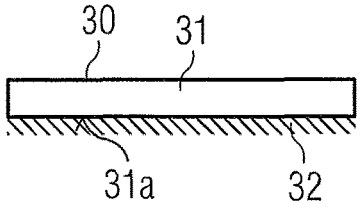
Figure 6:
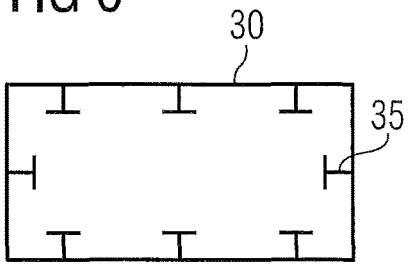
Figure 7A:
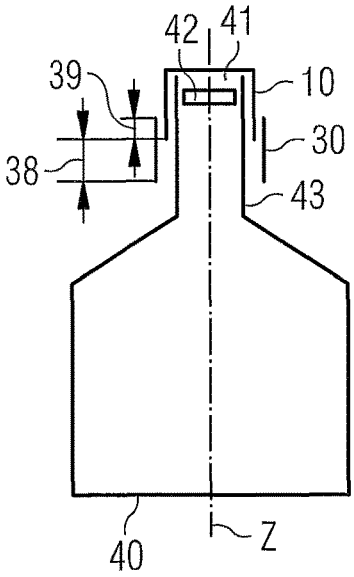
Figure 7B:
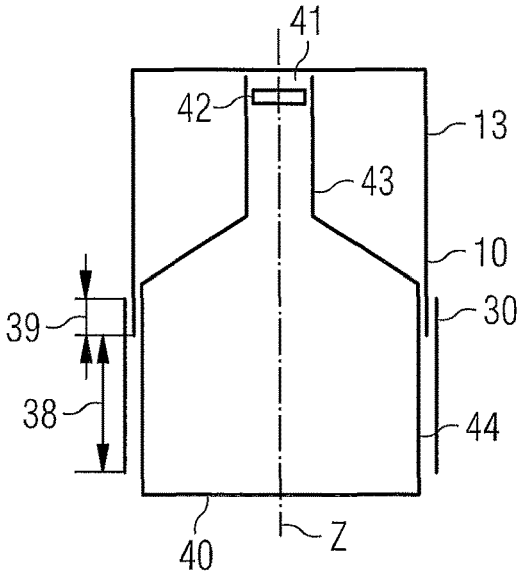
Figure 8A:
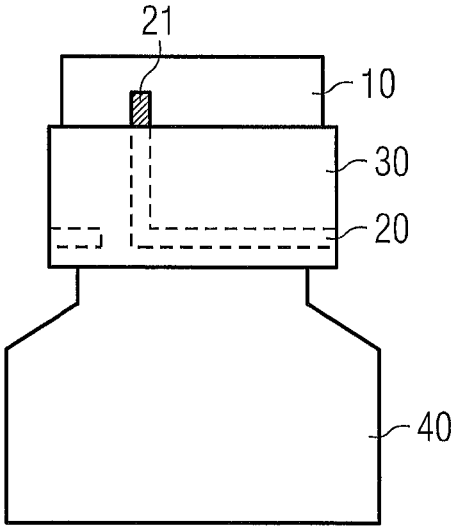
Figure 8B:
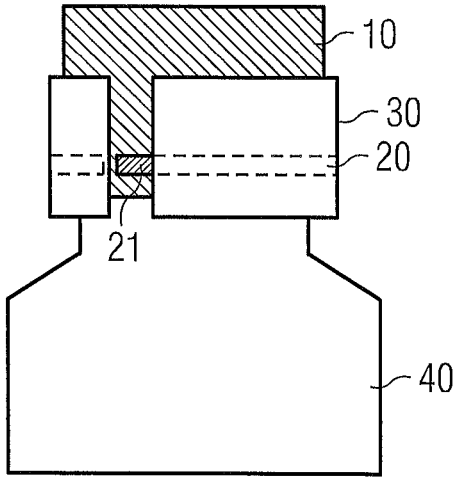
Figure 8C:
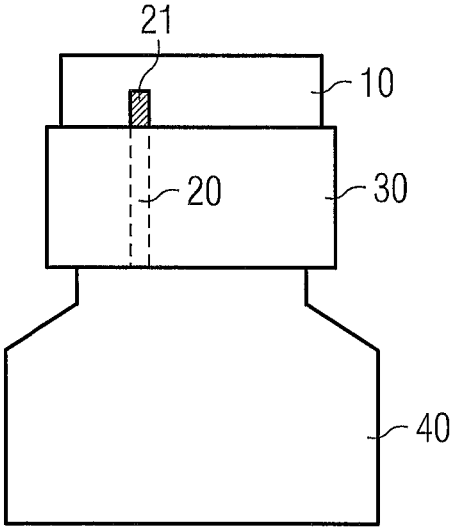
Figure 9:
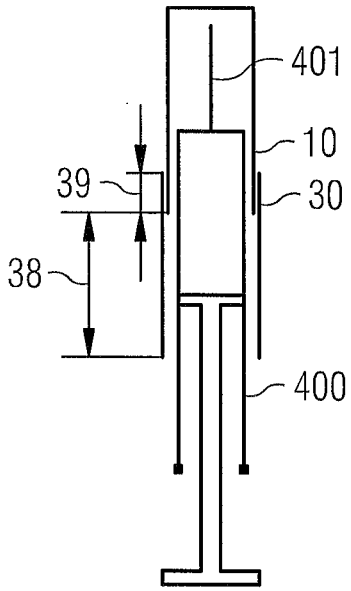
Figure 10:
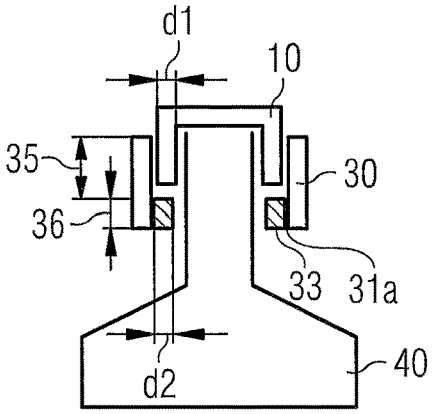
Figure 11:
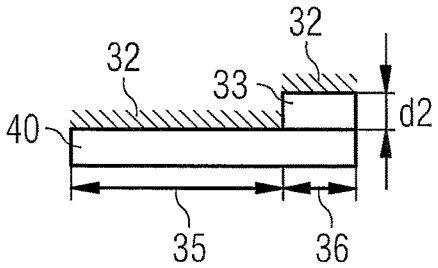
Figure 12:
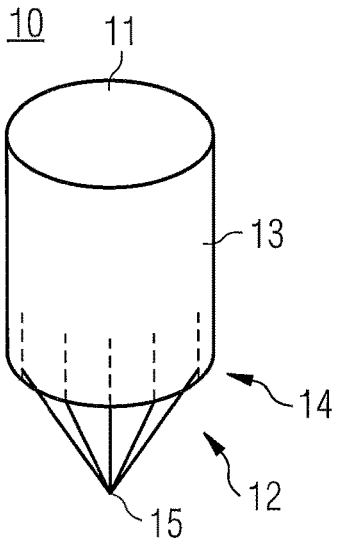
Figure 13:
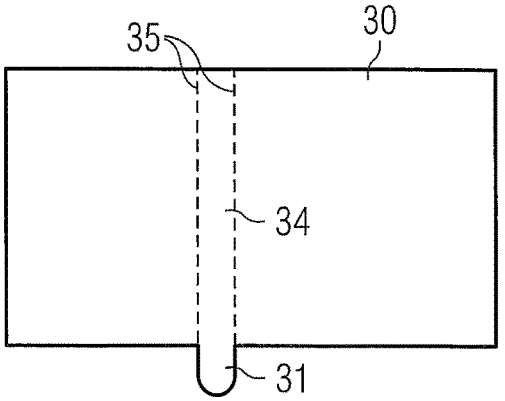
Figure 14:
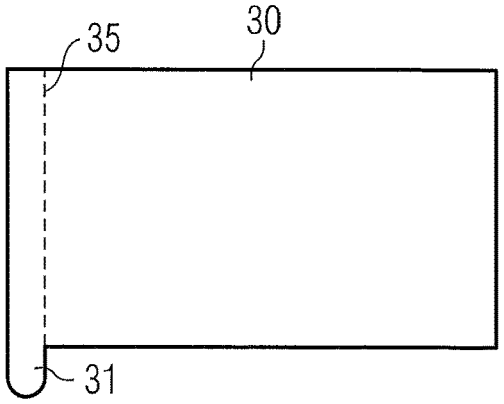

For explanation, some embodiments of the application will be explained by way of example based on the attached Figures. The Figures are only of schematic nature and the proportions, dimensions and/or relations between them are not necessarily true to scale. The Figures show the following;

FIG. 1: a side view of a closure capsule for a closure element;

FIG. 2: a side view of an alternative embodiment of a closure capsule;

FIGS. 3A to 3E: embodiments regarding the geometry of the closure capsule in an oblique view;

FIG. 4: a further embodiment regarding the geometry of the closure capsule in a cross-sectional view;

FIG. 5: a cross-sectional view of a label of the closure element or its closure capsule;

FIG. 6: a top view of an embodiment of a label comprising punched safety features;

FIG. 7A: a cross-section through a receptacle sealed with a closure element;

FIG. 7B: a cross-section through a receptacle sealed with an alternative embodiment of a closure element;

FIG. 8A: a top view of a receptacle sealed with a closure element;

FIG. 8B: a top view of a receptacle sealed with an alternative embodiment of a closure element;

FIG. 8C: a top view of a receptacle sealed with an alternative embodiment of a closure element;

FIG. 9: a cross-section through an injection syringe sealed with an embodiment of a closure element;

FIG. 10: a cross-section through a receptacle sealed with a special embodiment of a closure element;

FIG. 11: a cross-sectional view of a label for the embodiment of a closure capsule according to FIG. 10;

FIG. 12: an oblique view of a further alternative embodiment of a closure capsule for a closure element;

FIG. 13: a top view of a special embodiment of a label for a closure element comprising a capsule according to FIG. 12;

FIG. 14: a top view of an embodiment of a label for a closure element for a capsule according to FIG. 12, which is an alternative embodiment to FIG. 13;

FIGS. 15A to 15G: an embodiment of a closure element comprising a tear strip which is laterally offset with respect to the label, FIGS. 16A to 16F: an embodiment comprising a tear strip which is covered by the label, FIGS. 17A to 17H: various embodiments of the closure capsule, FIGS. 18A to 18D: two merely exemplary embodiments comprising an RFID chip, FIGS. 19A to 19E: two embodiments comprising a shield element over an RFID chip, FIGS. 20A to 20F: various embodiments of a label for the closure element, FIGS. 21A to 21D: various embodiments of a closure capsule comprising an ID code on its end face, and FIGS. 22A to 22E: various embodiments of a receptacle embodied as a spray bottle and comprising a closure element.

To begin with, FIG. 1 shows a closure capsule 10 for a first embodiment of a closure element. The closure capsule 10 illustrated here is a cylindrical capsule which is closed at its upper end 11 and open at its lower end 12.

Here, the closed end 11 may be completely closed; alternatively, said end 11 may also have a sort of "collar"

resulting in an edge. Due to said edge, this end will be constricted to such an extent that at least the opening on this side is greatly limited.

The closure capsule 10 is produced e.g. as a foil capsule made of one or more plastic foils, for instance one foil for the end face (or any other head top) and another one for the lateral area. Thus, the capsule is a print product whose raw material can be made to run over rolls as a web-shaped material, and then be punched, formed or processed and handled in some other way. Alternatively, the capsule 10 may also be produced from a (possibly a single) foil-like or massive plastic molded part. Polyvinylchloride (PVC), polyethylene terephthalate (PET) or oriented polystyrene (OPS) are candidates for the materials of the plastic capsule 10, for instance. The closure capsule 10 may be designed to be transparent or opaque or so as to be transparent or opaque in parts. Provided that it is opaque, an ID code (possibly in the form of an RFID chip comprising an electronic key, as a visual ID code or any other marking) arranged on the receptacle or its receptacle lid itself (for instance a vial cap) can be covered until the closure capsule 10 is opened and removed; in this way, it can go unnoticed for the time being.

The closure capsule 10 further comprises a tear strip 20. This tear strip 20 may be integrated in the closure capsule 14 as a separate piece. In this case, the tear strip 20 may be embodied, for instance, as a strip-like plastic foil, a thread or the like.

Alternatively, the tear strip 20 may be realized so as to form a part of the closure capsule 10 itself. In this case, the tear strip 20 can be detached from the remaining closure capsule 10 for instance by means of a perforation or a punched zone of similar design.

In each case, the tear strip 20 comprises a free end 21. This free end 21 can be detached from the closure capsule 10 and serves as a grip tab. For subsequently opening the closure element, a user may grip the grip tab 21, pull it and in this way open the closure capsule 10.

FIG. 2 shows an alternative embodiment of a closure capsule 10 comprising a tear strip 20. Whereas in the previously illustrated embodiment according to FIG. 1 the tear strip 20 extends radially along a circumferential line of the cylindrical closure capsule 10, the tear strip 20 extends in this alternative embodiment according to FIG. 2 parallel to the cylinder axis of the closure capsule 10. Here, the grip tab 21 of the tear strip 20 may be provided on the lower, open end 12 of the capsule or alternatively be attached on the upper, completely or partially closed end 11 of the capsule. In this case, too, the tear strip 20 may be realized as a separate element or may be a part of the closure capsule 10 which is separated by punched zones.

Regardless of the arrangement of the tear strip 20 on the closure capsule 10, the closure capsule 10 may also have one of many other shapes in addition to the cylindrical configuration already described above.

Figure 3A:
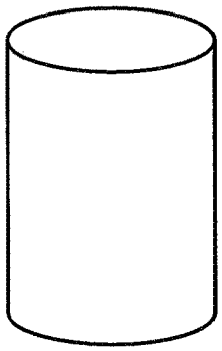
Figure 3B:
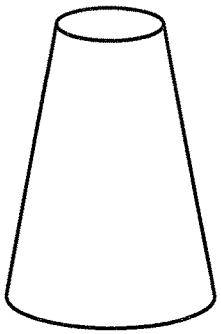
Figure 3C:
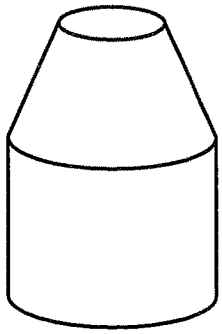

FIGS. 3A to 3E show some of those alternative shapes by way of example. FIG. 3A shows a conventional, cylindrical capsule. FIG. 3B illustrates a conical shape with a diameter which is smaller on the upper, closed end 11 than on the lower, open end 12. FIG. 3C shows a partially cylindrical embodiment. Here, the upper subarea has a conical design, whereas the lower subarea has a cylindrical shape. With the conical and partially cylindrical shape illustrated in FIGS. 3B and 3C, respectively, several of such capsules 10 can be readily stacked inside one another and require a relatively small transport volume.

Figure 3D:
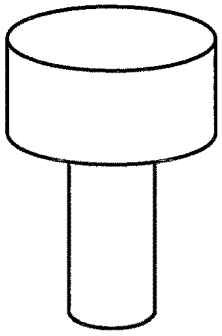
Figure 3E:
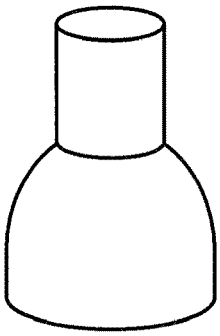

Furthermore, the capsules as illustrated in FIGS. 3D and 3E may have almost any other shapes which are adapted, for instance, especially to the opening area of the receptacle to be closed.

For the production of the desired shape of the capsule 10, said capsule may be produced so as to have the desired shape from the very beginning and will be available in this form for the closure of the receptacle. Alternatively, the capsule may also be produced from a material which can be thermally deformed or shrunk and receives its desired shape at a later point in time by the action of heat as is illustrated in FIG. 4, for example. To this end, the capsule 10 is put over a "forming tool" 100. Thereafter, the capsule 10 receives the shape of the forming tool 100 by the action of heat. This allows an easy variation of the shape of the capsule 10 by replacing the forming tool 100.

FIG. 5 shows a cross-section through a label 30 as it can be used for a closure element. The label 30 comprises a web-shaped substrate 31 which is made of a plastic foil or a paper web, for instance. An adhesive 32 is applied on the lower side 31A of the substrate.

FIG. 6 shows a top view of the label 30 described above. In the case which is illustrated here, the label 30 has its outer edges provided with additional weakening lines 35, in particular punched zones. These punched zones are implemented as so-called punched safety features and have the effect that the label 30 begins to tear at these punched zones in the case of an attempt to detach the affixed label 30 from a subsurface. Apart from the T-shaped punched safety means or weakening lines 35 illustrated here, other shapes for the punched zones are possible as well.

FIG. 7A shows a cross-section through a receptacle filled with a pharmaceutical liquid. In the upper region, this receptacle 40 has an opening 41 through which the liquid can be filled in and taken out. In the illustrated Figure, the opening 41 is closed with a seal 42.

For the purpose of sealing the receptacle 40, a closure capsule 10 is put over the opening 41 first. As a next step, a label 30 is wrapped around the bottleneck 43 and affixed thereto such that it is connected to the capsule 10 in a first area 39 and connected to the bottleneck 43 in a second subarea 38. In this way, the closure capsule 10 is firmly connected to the receptacle 40 by means of the label 30 and cannot be detached without destroying the label 30.

FIG. 7B shows an alternative arrangement of a closure element on a receptacle 40. Here, a closure capsule 10 is put over the opening 41 in such a manner that the capsule 10 covers the opening as well as the entire bottleneck 43. The lateral area 13 of the closure capsule 10 extends downward to the bottle body 44 of the receptacle 40. Subsequently, the label 30 is attached to the lower area 44 of the receptacle 40 such that the capsule 10 is fixed. In doing so, a cavity is produced in the upper area between the bottleneck 43 and the capsule 10.

This embodiment allows for the attachment of a somewhat larger label 30, as the lower area 44 of the receptacle 40 usually has a larger circumference. Thus, a larger surface area is made available for lettering the receptacle 40.

FIG. 8A shows a top view of a first embodiment of a closed receptacle. Here, the closure capsule 10 comprises a radially surrounding tear strip 20. The free end 21 of the tear strip has been folded so as to point toward the upper end of the closure capsule 10. Subsequently, the label 30 is positioned on the closure capsule 10 and the receptacle 40 in such a manner that the label is connected to the closure capsule 10 in an upper subarea and affixed to the receptacle 40 in a lower subarea. As the grip tab 21 of the tear strip 20 has been folded in upward direction, the grip tab protrudes beyond the label and can be readily grasped in order to open the seal at a later point in time.

FIG. 8B shows an alternative embodiment of a receptacle 40 which has been sealed with a closure element. In this case, too, the closure capsule 10 comprises a radially surrounding tear strip 20. The free end 21 of the tear strip 20, however, is not folded upward or downward in this case. Rather, the label 30 is arranged in exact position in this case, in fact in such a manner that the free end 21 is not covered by the label 30. This is why the free end 21 comprising the grip tab of the tear strip 20 does not have to be folded in this case, but it is required to apply the label 30 in the correct position on the receptacle 40 comprising the capsule 10.

FIG. 8C shows a further alternative embodiment of a closure element. In this case, the closure capsule 10 comprises a tear strip extending parallel to the cylinder axis of the capsule. Therefore, it is inevitable that the grip tab 21 of the tear strip 20 protrudes beyond the label 30 in upward or downward direction.

In those embodiments which are described in connection with FIGS. 8A to 8C, the closure capsule 10 is fastened to the bottleneck 43 by means of the label 30, as schematically shown in FIG. 7A. As an alternative, all embodiments described above may also be fastened to the bottle body 44, as described above with reference to FIG. 7B.

FIG. 9 shows the use of a closure element on an injection syringe 400. In this case, the closure capsule 10 may be put over the area comprising the injection needle 401. Then, the capsule 10 is fixed to the syringe body by means of the label 30. This example shows that the term "receptacle for pharmaceutical liquids" does not only include glass or plastic bottles, but also any other kind of containers intended for pharmaceutical liquids and comprising an opening which is to be sealed in a reliable manner. The injection syringe 400 may additionally comprise a needle protection (needle shield or also rigid needle shield) which encloses the injection needle 401 after use and in this way protects the hospital staff against accidental injuries. The injection needle 401 can be connected to the injection syringe via a Luer lock, a Luer cone or even by means of a simple plug-in connection, for instance.

FIG. 10 shows a further embodiment of a closure element on a receptacle 40. As illustrated in this Figure, the closure capsule has a thickness d1 along its lateral area 13. Due to said thickness d1, the outer circumference of the closure capsule is somewhat larger than the slightly smaller outer circumference of the receptacle 40. If a single-ply label 30 is provided so as to cover the larger circumference of the closure capsule 10 as well as the smaller circumference of the receptacle 40, it may be that the label 30 is caused to wrinkle.

In order to counteract said formation of wrinkles, it is possible to apply a further material layer 33 in the lower area 36 of the label 30 on the lower side 31A, wherein the material layer 33 has a thickness d2 which is approximately equal to the thickness d1 of the lateral area 13 of the closure capsule.

FIG. 11 shows a cross-section through such a label 30. The area 36 of the label web is provided with a further material layer 33 having the thickness d2. On top of it, an adhesive 32 is also applied.

FIG. 12 shows a further embodiment for a closure capsule 10. The lateral area 13 of the cylindrical capsule comprises several weakening lines 15. The weakening lines 15 extend preferably parallel to the cylinder axis of the cylindrical capsule 10. However, other shapes of the weakening lines 15 are possible, too.

All the weakening lines 15 in the lateral area 13 end on an edge line 14 at the lower edge, where the lateral area 13 continues into the open end 12 of the closure capsule 10. In this way, starting points are produced at the intersections between said edge line 14 and the end points of the weakening lines 15; at these starting points, the closure capsule 10 is very prone to be torn.

The weakening lines 15 may be realized as perforations, for example. Alternatively, a partially punched zone (i.e. a punched zone which penetrates the foil material of the closure capsule 10 only in part) is also possible.

FIG. 13 shows a label 30 for said alternative embodiment of the closure capsule 10. The label 30 has an approximately rectangular shape here. In this case, too, the label 30 is provided with an adhesive on one side. In doing so, the label may be coated with the adhesive over the full surface area or alternatively in subareas only.

Moreover, the label 30 comprises several weakening lines 35. The weakening lines 35 each end at two opposite outer edges of the label 30. In this way, a tear strip 34 is defined between the weakening lines 35.

The weakening lines 35 may be perforations, for instance. Alternatively, it is also possible to provide punched zones in the label 30 which are only partially punched.

The label 30 may further comprise a grip tab 31. Said grip tab 31 may be implemented, for instance, as a continuation of the label on a subarea of an outer edge. The grip tab is situated, for example, along a region of an outer edge, which is delimited by two weakening lines 35.

In order to facilitate the process of grasping this grip tab 31, it is realized so as to be non-adhesive on the lower side, in contrast to the remaining label 30. To this end, it is possible that the grip tab is not provided with an adhesive at all. Alternatively, an adhesive which has been applied beforehand can be weakened or neutralized by applying a suitable substance.

FIG. 14 shows an alternative embodiment for a label 30. In this embodiment, the label 30 comprises only one weakening line 35. Further, the grip tab 31 is arranged between an outer edge and the one weakening line 35. This results in the formation of a tear strip 34 between this outer edge and the weakening line 35.

If a closure capsule 10 described above and comprising weakening lines 15 is attached to a receptacle and the latter is gummed up with a label 30 also provided with the weakening lines 35 described above, the weakening lines 15 of the capsule 10 as well as the weakening lines 35 of the label 30 extend in this arrangement almost parallel to the longitudinal axis Z of the receptacle 40 delineated in FIGS. 7A and 7B.

In order to be able to remove the capsule 10 and hence to gain access to the seal 42 of the receptacle 40, the label 30 has to be opened beforehand. This is carried out by a user grasping the grip tab 31 and pulling it. In doing so, the label 30 is torn first along the weakening lines 35. Consequently, the label 30 is irreversibly destroyed and cannot be used again.

As the label 30 is also connected to the capsule 10, the capsule 10 will also be torn along the weakening lines 15 during the opening procedure upon pulling the grip tab 31. This has the effect that during the opening procedure the closure capsule 10 is irreversibly destroyed as well.

As the capsule 10 and the label 30 are irreversibly destroyed during the opening procedure in all embodiments, it is not possible to use these parts once again to reclose the receptacle. A closure element which has been destroyed in this way can be readily identified by a user, so that a fraudulent reuse is prevented.

Moreover, it is also possible to integrate additional safety features in the closure capsule 10 and/or the label 30. This gives proof of a manipulation attempt in a very efficient manner. By way of example, a hologram may be used as a further safety feature. Special printing inks reacting sensitive to light incidence or heat may also be used as additional safety features. Any other suitable safety features are also possible.

In summary, a closure element intended for a receptacle is provided which is irreversibly destroyed during the first attempt of opening it. The closure element comprises e.g. a plastic capsule closing the opening of the receptacle, a label for fixing the plastic capsule on the receptacle, and a tear strip which allows for the opening of the closure element, in particular for the removal of the capsule in order to uncover the opening of the receptacle. As the closure element is irreversibly destroyed during the first opening process, the closure element cannot be reused for sealing a counterfeit product with an original closure element, for example.

Figure 15A:
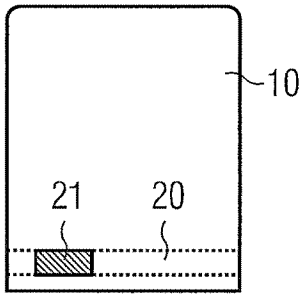
Figure 15B:
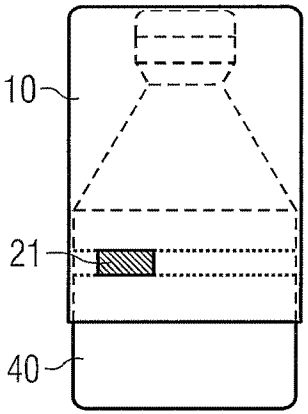
Figure 15C:
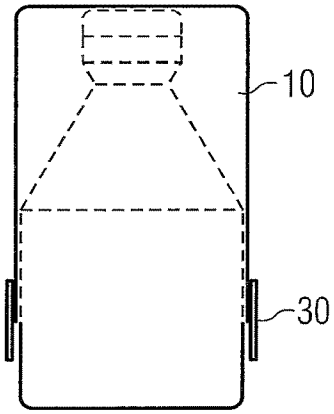
Figure 15D:
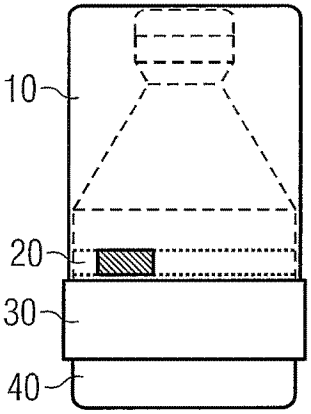
Figure 15E:
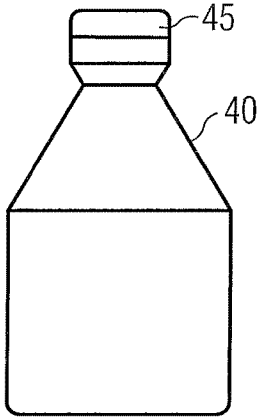
Figure 15F:
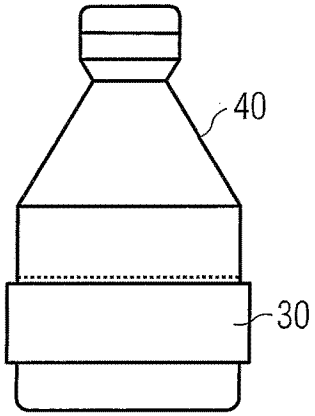
Figure 15G:
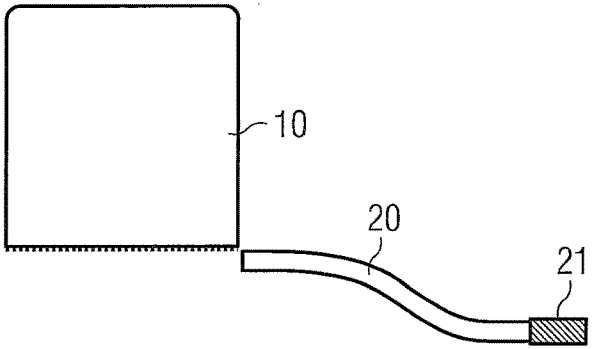

FIGS. 15A to 15G show an embodiment of the closure element, in which the tear strip 20 is arranged to be laterally offset with respect to the label 30, that is to say offset to the label 30 in the direction of symmetry (i.e. in axial or perpendicular direction of the closure element or receptacle). FIG. 15A shows the closure capsule 10 which has the tear strip 20 worked into it, for instance defined by weakening lines or perforations. The tear strip 20 may also be a distinct, separate element which is arranged on or in the closure capsule 10. However, at least the grip tab 21 is outside the lateral area of the closure capsule 10 (which may be cylindrical, for instance). FIG. 15B shows the receptacle 40 with the closure capsule 10 put over it, but still without any label. Said label can be seen only in FIG. 15C (in cross-sectional view) and FIG. 15D (in a side view). FIG. 15D shows that the tear strip 20 is arranged above the label 30; this means that the tear strip, when being pulled, severs and destroys the capsule but not the label. FIG. 15E shows the receptacle 40 before attaching the closure capsule 10 of FIG. 15A. FIG. 15F shows the receptacle 40 after having pulled off the tear strip 20 in FIG. 15D and having removed the closure capsule; only the label 30 and a lower edge of the closure capsule underneath it still adhere to the outer circumference of the receptacle 40. The removed closure capsule 10 and the tear strip 20 are illustrated in FIG. 15G. The closure capsule has been damaged and cannot be used anymore; this offers a tamper-evidence feature which can also be combined with further verification, lettering or identification features (which may serve for identifying an individual receptacle, for instance) of the present application.

FIGS. 16A to 16F show a similar embodiment in which the label 30, however, is affixed so as to lie over the tear strip 20 to a large extent; this is why the label is severed during the tearing process (the label alone or in addition to the closure capsule). According to FIG. 16A, the tear strip 20—over which the label will be affixed at a later point in time—may have its grip tab 21 folded down, i.e. angled or bent, so that it points upward or downward (in the direction of symmetry of the closure capsule 10) in order to be exposed at least at the outermost end in a region which is not covered by the label. Alternatively, the grip tab 21 may extend as illustrated in FIG. 15A, as long as it is ensured in any other way that the grip tab is still exposed even after having affixed the label 30 over it. By way of example, the label 30 may be designed as a "quasi" wraparound label, i.e. a label which is not wrapped around the full circumference of the closure capsule 10 and/or of the receptacle 40 (i.e. only partially wrapped around it). In this case, the grip tab is exposed in the portion of the outer circumference which is not covered by the label. As an alternative or in addition, a cutout, a recess or any other opening may be formed in the label in the vicinity of the grip tab (cf. FIG. 20E or 20F), so that the latter is exposed.

Figure 16A:
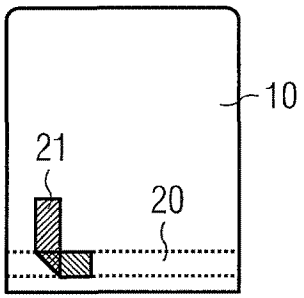
Figure 16B:
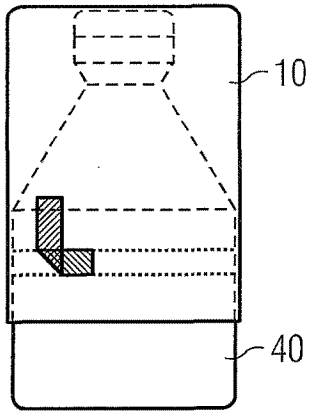
Figure 16C:
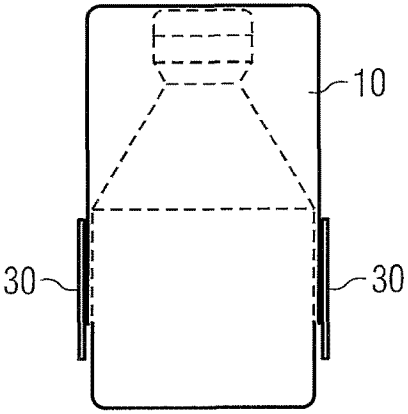
Figure 16D:
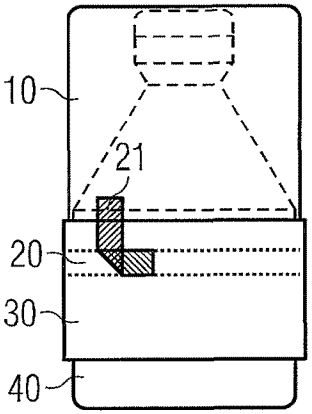
Figure 16E:
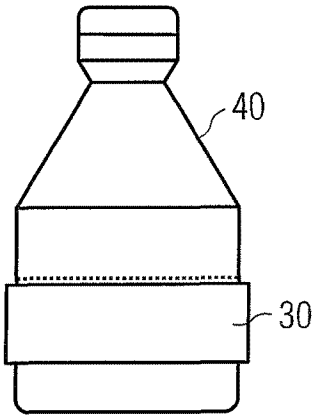
Figure 16F:
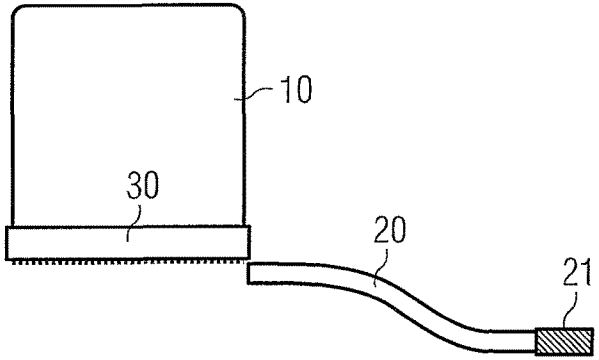

FIG. 16B shows the receptacle 40 with the closure capsule 10 fitted to it, but still without the label 30. The latter is only illustrated in FIGS. 16C (in a cross-sectional view) and 16D (in a side view). FIG. 16D shows that the grip tab 21 which has been folded upward is exposed above the label 30, although the remaining area of the tear strip 20 is covered by the label 30. According to FIGS. 16E and 16F, a part of the label 30 remains on the receptacle 40 as well as on the closure capsule 10 when the opening process has been carried out with the aid of the tear strip 20; here too, the closure capsule is destroyed and cannot be reused without further ado. The exemplary embodiments of FIGS. 15 and 16 may be especially provided with further safety features, in particular identification features which designate the very specific, individual specimen of the receptacle and/or of the closure element and are arranged for this purpose in such a position that they are destroyed and rendered unusable when pulling off the tear strip 20. When the first-time opening process has occurred and the closure capsule 10 and/or any other parts of the closure element have been removed from the receptacle, a repeated reuse for another receptacle (which has not been produced, filled or otherwise authorized by the original manufacturer or at least an appointed dealer) is made impossible. Instead of a cylindrical (in particular a circularly cylindrical) lateral area 30, the receptacle shown in FIG. 16E may alternately have—just as the receptacles of the remaining embodiments of this application—an angular lateral area which is in particular rectangular or formed from other, several partial circumferential areas. Any other rounded circumferential areas such as oval circumferential areas made up of one or more bent partial circumferential areas or other subareas are conceivable as well. Provided that the tear strip is a constituent part of the closure capsule and is arranged underneath it, it induces the separation of a section of the closure capsule preferably during the tearing process, said section surrounding the entire circumferential area of the receptacle and remaining thereon. The major part of the closure capsule, however, can be pulled off from the object or receptacle, when the tear strip has been pulled off or torn open.

Figure 17A:
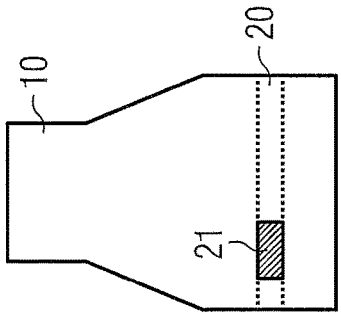
Figure 17B:
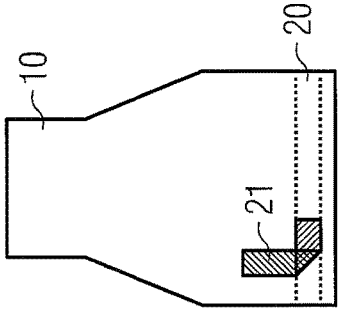
Figure 17C:
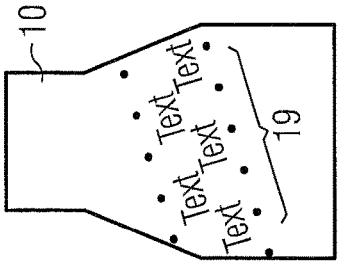
Figure 17D:
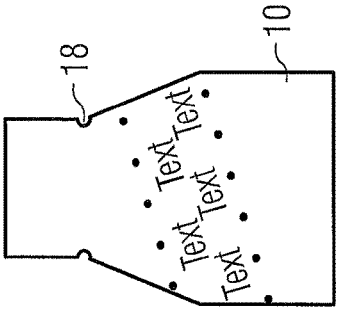
Figure 17E:
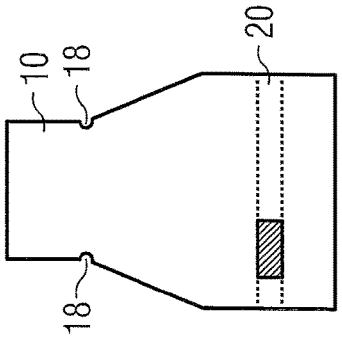
Figure 17F:
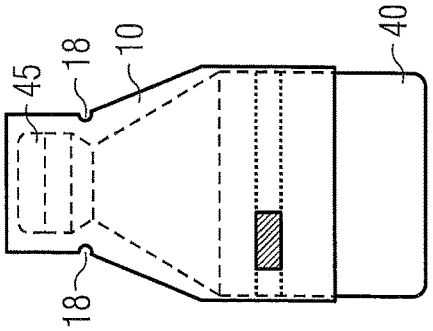
Figure 17G:
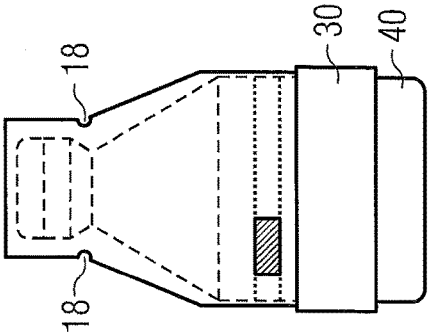

FIGS. 17A to 17H show various embodiments of the closure capsule 10—either as an alternative to or combinable with the embodiments of FIGS. 3A to 3E, 7A to 9 and/or 12. In FIGS. 17A to 17G, the closure capsule 10 is conical in part, in particular in a middle area (between a lower and an upper circularly cylindrical area comprising different diameters). The specific shape can be varied as desired; by way of example, reference is made again to FIGS. 3A to 3E, 7A to 9 and/or 12. FIG. 17A shows a closure capsule comprising a conical section. However, the tear strip 20 (which has been worked into the capsule's material or separately fastened therein) extends as in FIG. 15A. In FIG. 17B, the tear strip extends as in FIG. 16A. FIG. 17C shows a lettering 19, for instance in the form of an imprint or an embossing. In particular a lettering which has been embossed in the material of the closure capsule 10, can hardly be removed in a non-destructive manner. In the other embodiments of this application, imprints, embossings or other letterings, in particular those of the label 30, are not specifically depicted for the sake of an easier presentation. FIG. 17D shows a groove 18 at a level between the upper, for instance circularly cylindrical portion and the middle, for instance conical portion of the closure capsule 10. A similar capsule provided with the illustrated tear strip, but without lettering 19, is shown in FIG. 17E. If this closure capsule 10 is placed on a receptacle 40, as is shown in FIG. 17F, the groove 18 may laterally encompass a circumference of the receptacle cap 45 which is protected in this way in terms of falling off and/or being pulled off. This ensures that the closure capsule also remains on the receptacle in future storing and handling of said receptacle. This has the advantage that the labeling, i.e. the process of attaching a label, as illustrated in FIG. 17G, can be carried out at a much later point in time. This temporal separation of the steps of closing and labeling a receptacle (in particular for pharmaceutical liquids or any other pharmaceutical products) has the advantage that the closed receptacle can be stored first (even for a longer time), and can also be cooled, for instance, whereas the process of labeling and hence individualizing the available receptacles can be performed as necessary depending on demand or incoming orders. This allows, for instance, a larger, complete series of a defined number of receptacles to be filled and closed, and to be provided with the closure capsules (protected by their respective grooves) and to also to be stored for a long time. If there should be a specific order request at a later point in time, a part of the stock of the receptacles prepared in this way can be labeled afterwards according to the requested amount or number of receptacles (FIG. 17G). This has the advantage that much more individual information on the receptacle and the pharmaceutical product as well as its use and intended purpose can be printed on the closure element or provided thereon in other encrypted, possibly electronic form. In the case of medicinal drugs, an addressee, a patient or a planned administration period can be imprinted as an integral part of the individual marking of the respective receptacle.

The closure capsule 10 comprising a groove 18 can also be attached to (prefilled) syringes. Alternatively or in addition, the closure capsule 10 may also be fixed by a thermal shrinking process.

Figure 17H:
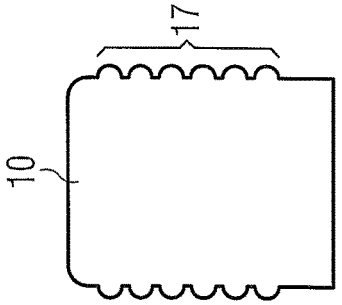

FIG. 17H shows an alternative embodiment of a closure capsule 10 whose outer circumference is provided with a fluting 17 in the form of several flutes or indentations. This has the advantage that the outer circumference (which in this case has a circularly cylindrical basic shape, for example) has a higher torsional rigidity, i.e. is rendered more robust against mechanical deformations, for instance to provide a protection against the breakage of glass (for receptacles made of glass) in the event of shocks from outside.

FIGS. 18A to FIG. 18D show two further developments in which an identification feature is provided for the electronic encryption of an ID code, safety code or any other code which is suitable for individualizing a respective receptacle. According to FIG. 18A, a receptacle 40 has a closure element fastened thereto, which is further provided with an RFID chip 1 in addition to the closure capsule 10 (see FIGS. 19A, 15B or 16B) and the label 30 (see FIGS. 15D or 16D). An antenna 2 for reading out the RFID chip 1 is also provided; said antenna may extend around the RFID chip e.g. in the manner of a ring or spiral or anyway in the form of a plurality of loops or turns. It is preferred that the RFID chip is a passive RFID chip which is suitable for storing an electronically encrypted ID code (basically, any other chip which cannot be read out via RFID could also be used). The readout process is then performed from outside with the aid of a reading device and an excitation of the chip via the antenna 2. To this end, any suitable technology such as RFID (Radio Frequency Identification) can be used, for instance NFC (Near Field Communication), or alternatively Bluetooth. RFID for reading out the chip is particularly suitable for the readout over short distances of only few centimeters. An individual, consecutive number or other marking assigned to the specific closure element or receptacle and its pharmaceutical content can be stored in the chip. The RFID chip can be read out in particular by a smartphone or optionally an iPhone, permitting the access to an electronic database in the internet or at any other place, in order to verify—on the part of the original manufacturer—the authenticity of the pharmaceutical product, of its receptacle or in particular of the closure element which is described here, for instance. The access authorization of the user or operator can also be checked by reading out the RFID code. Alternatively or in addition, a further identification feature (such as a visual ID code; more on this later) offers the possibility to check the access authorization of the user or operator already prior to reading out the RFID code. To this end, further elements (in particular visual ID codes) may be provided in or on the closure element to authorize the process of matching the data with an external database. This implies that such further markings, in addition to the RFID chip, are arranged in such a position that they can be read out and scanned, creating even further enhanced safety during tracking the merchandize traffic of the marked receptacles.

Figure 18B:
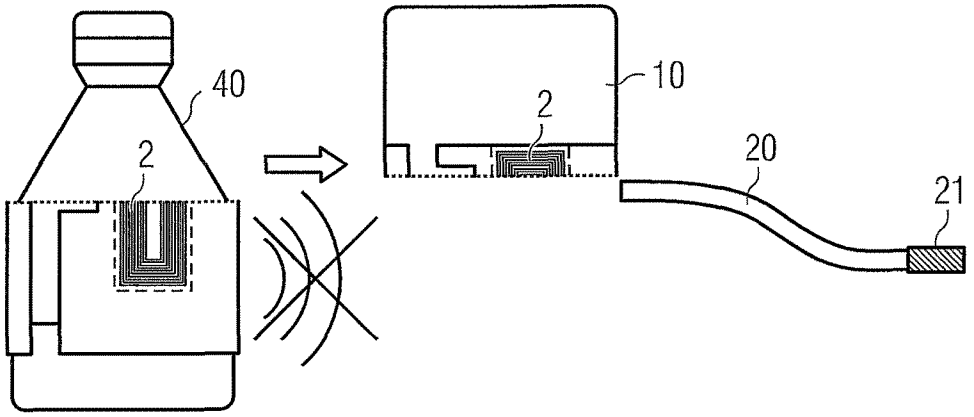
Figure 18D:
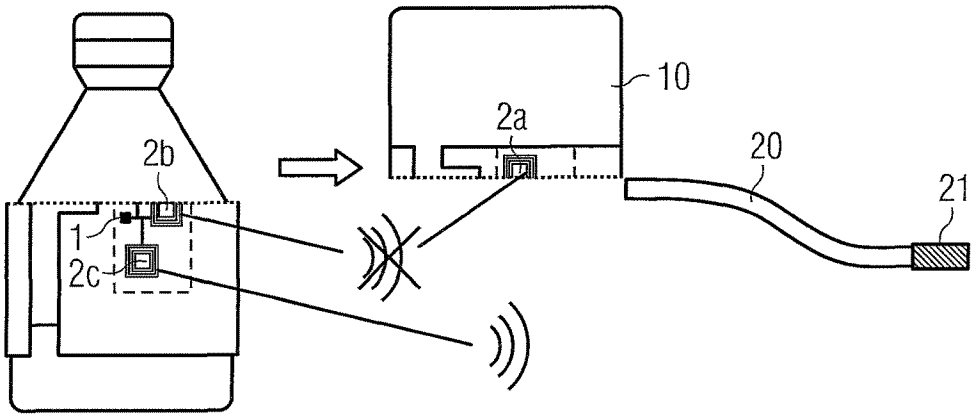
Figure 18A:
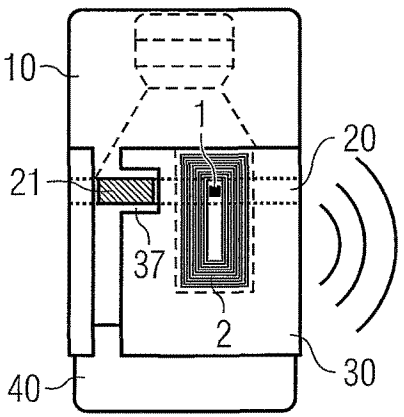

According to FIG. 18A, the tear strip 20 extends in such a way that that it removes the RFID chip 1 or at least separates it from its antenna, i.e. destroys the antenna 2 during pulling it. The turns of the antenna are severed, for instance. As in the other embodiments of the application, it does not matter if the tear strip (which may also be implemented as a tear thread or the like) extends in azimuthal fashion around the circumferential area of the closure element or receptacle or is perpendicular or transverse relative thereto, for example. The tear strip may also extend in diagonal or spiral fashion on the outer circumference; the respectively desired crack formation and tear stabilization is achieved by the positioning of the weakening lines or perforations in the closure capsule 10 and/or the label 30 or simply by the course of a separate tear strip relative to these. The recess which is illustrated in FIG. 18A and intended to initiate the cracking process in a controlled manner and then guide the further crack formation through the label and/or through the closure capsule ensures that reading out the RFID chip is prevented in the future as soon as the closure element has been opened for the first time (by pulling the grip tab 21). Such a recess or another cutout—as well as the grip tab 21 itself which is visible from outside—can be used as a positional marking or index marking during the automatic process of labeling the receptacle, for instance in order to ensure the correct rotational orientation of a cylindrical receptacle prior to attaching an RFID chip 1 and/or the label to it, or to make the imprint on the label at the correct place or to provide it with further elements. These options apply to all embodiments of the present application. It is also possible to attach an optional closure seal or tear seal in addition to the label (as a further indicator that the closure element has been torn or damaged by the tear strip at least in parts or torn or damaged in another way); said seal is also severed when the tear strip 21 is pulled.

Thus, the closure element illustrated in FIG. 18A is especially suited to check (prior to the first-time opening of the receptacle provided therewith, specifically, prior to pulling off the tear strip 20) if the data stored in the RFID chip 1 correspond to those of an external database (say of the original manufacturer or of an authorized dealer or user, for instance a physician) or not. In this way, counterfeit plagiarisms can be distinguished from genuine products or it is possible to determine whether the identification number stored in the chip has already been used elsewhere and a product provided therewith has been opened. This makes it possible to check for the originality of the closure element which shows an undamaged external appearance, in particular to verify whether it has been used indeed for the first time or has been reused in an unauthorized manner after removal from another receptacle.

Figure 18C:
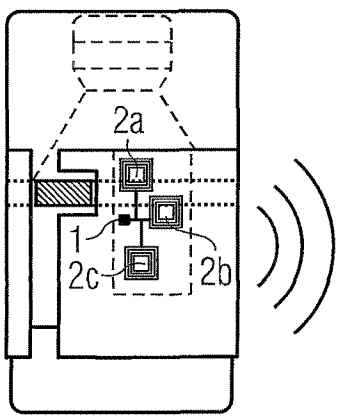

FIG. 18B shows the severed and destroyed antenna 2 after having pulled off the tear strip and severed the upper part of the closure capsule 10 from the receptacle 40. FIG. 18C shows a further development with respect to FIG. 18A; here, a plurality of antennas 2A, 2B, 2C are connected to the RFID chip 1. At least one antenna 2A is arranged such that it is destroyed when pulling the tear strip 20, whereas at least one other antenna 2C is arranged such that it remains intact during pulling off the tear strip. Therefore, the antenna 2C can still be used after having opened the closure element, for instance to allow a limited communication with the RFID chip even after having opened the closure element. This allows to read out e.g. an identification code via the antenna 2C, whereas other information or programs cannot be retrieved from the chip any more. FIG. 18D shows the state after the tearing process and after having removed the closure capsule 10 from the receptacle; a communication with the chip via the destroyed antennas 2A, 2B is not possible any more.

Figure 19A:
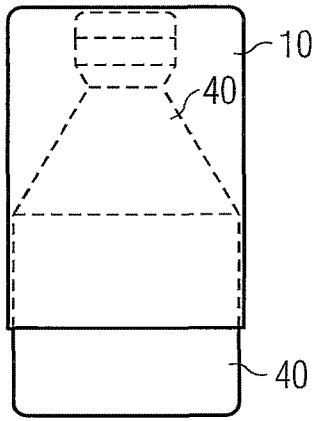
Figure 19B:
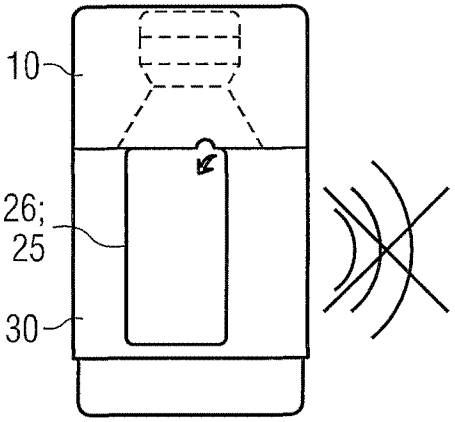
Figure 19C:
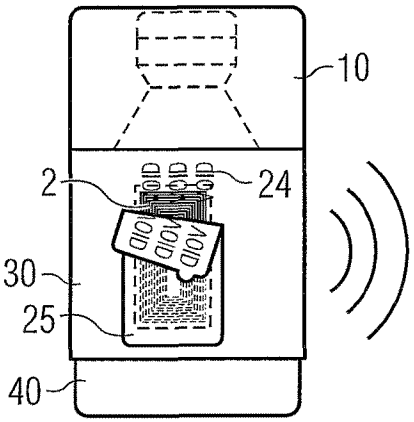
Figure 19D:
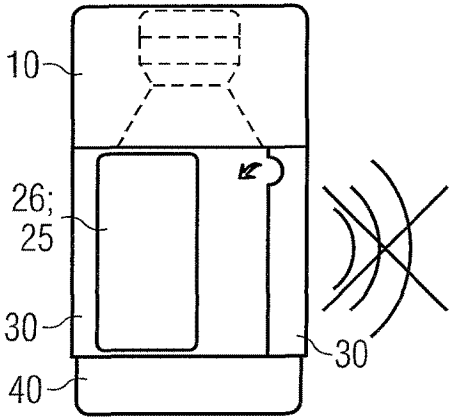
Figure 19E:
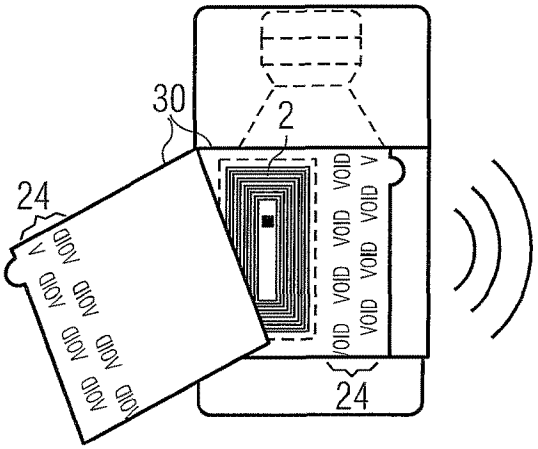

FIG. 19A to FIG. 19E show further developments to FIGS. 18A to 18D. According to FIGS. 19B to 19E, one shield element 25 ("shielding") is provided in each case, which prevents any communication with the RFID chip 1 for the moment, but can be peeled off from it. This prevents, for example, a communication with the chip through outer packagings which are not open yet. FIG. 19A shows the receptacle with a closure capsule 10 placed over it. FIG. 19B additionally shows the label 30 carrying the shield element 25 in the form of an overlay label. The latter is provided with its own pull-off tab and is to be peeled off individually prior to opening the closure element, to read out the RFID chip 1 (FIGS. 18A or 18C) immediately thereafter. As in FIGS. 18A or 18C, the RFID chip and its antenna can be selectively arranged on the outer side of the label 30, on its inner side or in the interior thereof (as an inlay) or between the label and the closure capsule 10. It is also possible to arrange the chip and the antenna on the inner side or inner wall of the closure capsule 10 or as an inlay of the closure capsule itself (which may also be a foil capsule), for instance on its lateral area. In all cases, the shield element 25 prevents access to the data content of the RFID chip. It is preferred that the shield element is a conductive, in particular metallic layer, for instance in the form of an aluminum foil or any other foil or coating made of a conductive material. The embodiment according to FIG. 19B has the purpose of allowing a readout of the RFID chip only immediately prior to opening the closure element, as soon as the shield element 25 is about to be removed as shown in FIG. 19C. According to FIG. 19C, a void area 24 may be provided on the label 30 and/or its overlay label in the region of the shield element 25 (or alternatively in its vicinity), to visualize a first-time, also partial removal of the shield element 25 and in this way irreversibly signaling any unauthorized manipulation attempts. According to FIG. 19D, the label may also be embodied as a multi-wraparound label which encircles the closure capsule 10 and the receptacle 40 to such an extent that it comes to lie on itself and leaves some space in the overlap area for a shield element 25. The latter may be arranged on the outer or inner side of a section (to be peeled off first) of the label 30; when present on the inner side, it is not visible from outside as the case may be, but nevertheless it prevents the RFID chip underneath it to be read out. Only when the multi-wraparound label (FIG. 19E) has been peeled off at least in part, the communication with the RFID chip can occur. As in FIG. 19C, void areas 24 may be provided here as well. Irrespectively of the void areas, a repeated reclosing process of parts of the label is still possible, for instance in terms of repeatedly taking out sub-quantities from the receptacle.

Figure 20B:
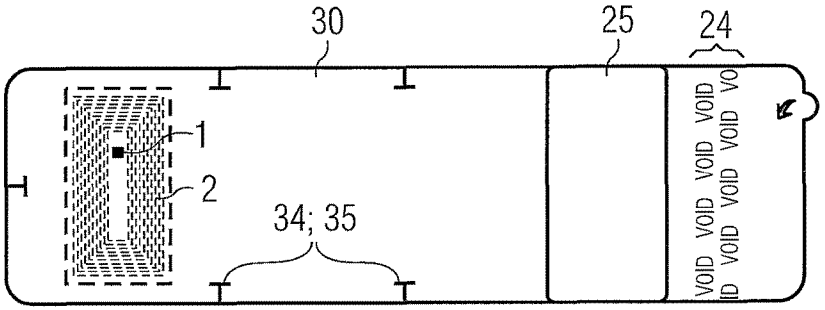
Figure 20A:
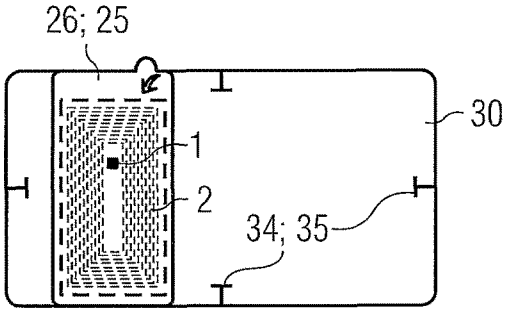
Figure 20E:
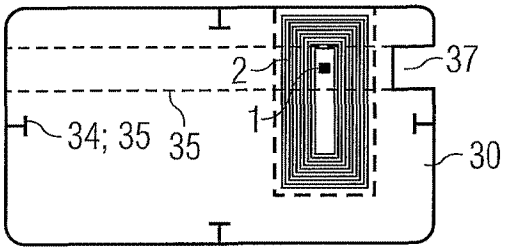
Figure 20C:
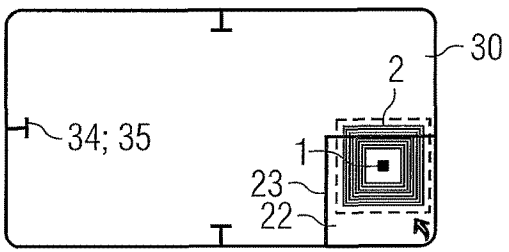
Figure 20F:
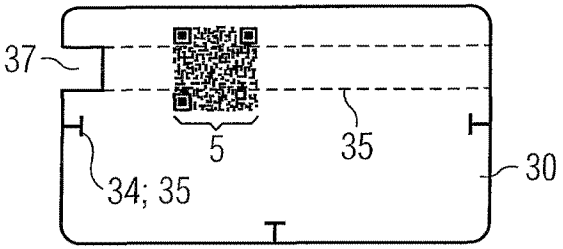
Figure 20D:
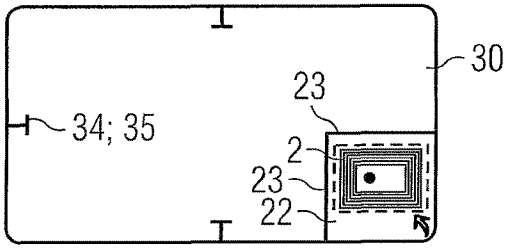

FIG. 20A to FIG. 20F show various embodiments of a label 30. The label according to FIG. 20A is a label which surrounds the circumference of the receptacle only in part or, insofar as it is a multi-wraparound label (picture not true-to-scale), does not cover the RFID chip 1 and the antenna 2. Instead, the shield element 25 is formed as an overlay label 26 which is provided with its own grip tab and can be peeled off from the RFID chip. Further, the edges of the label are additionally provided with punched zones 34 or other weakening lines 35 to hamper the removal of the label 30. The label of FIG. 20A is suitable for the closure element of FIGS. 19B and 19C. The label of FIG. 20B, however, is particularly suitable for the closure element according to FIGS. 19D and 19E. In this respect, reference is made to the related description. The embodiments of FIGS. 18 to 20 also allow for the arrangement of the RFID chip 1 and the antenna 2 externally or internally on the label 30. They may also be integrated as an inlay in the label itself and be arranged in various layers as well; in all cases, the shield element 25 establishes an effective covering. FIGS. 20C and 20D show labels 30 in which the RFID chip 1 and the antenna 2 are arranged on a severable section 22 of the label 30. The severable section 22 is delimited from the remaining part of the label 30 by a separating line 23 (a weakening line or perforation) and hence can be torn off. According to FIG. 20C, the antenna 2 protrudes partially into the remaining part of the label 30 and thus is severed along the parting line 23 during tearing off the section 22, i.e. is destroyed. In this process, the RFID chip is destroyed. According to FIG. 20D, the antenna 2 lies completely within the section 22, i.e. is kept intact on tearing off the section 22. The RFID chip 1, which is arranged on the section 22 together with its antenna 2, can be further used, in particular can be adhesively affixed to another object (for instance a patient record).

FIG. 20E shows a label 30 comprising an indication of the course of the crack formation for the tear strip 20 of the closure element. For the sake of a proper initiation of the rupture and/or for exposing its grip tab 21, a recess 37 or another cut-out, perforation or weakening line is provided, for instance, so that at least the antenna 2 of the RFID chip 1 will be severed together with the label. FIG. 20F shows an embodiment in which instead of the RFID chip 1 a visual ID code 5 (for instance a QR-code, a two-dimensional code or a barcode) is destroyed in the tearing process. In the other Figures of the present application, too, in particular in FIGS. 18A to 20E, such a visual ID code 5 may be arranged instead of or in addition to the RFID chip 1 (and its antenna 2); the embodiments are equally well suited for the purpose of destroying a visual ID code 5 when the receptacle is opened for the first time.

Figure 21A:
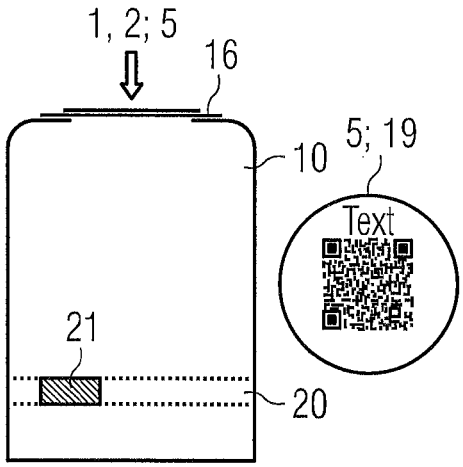
Figure 21B:
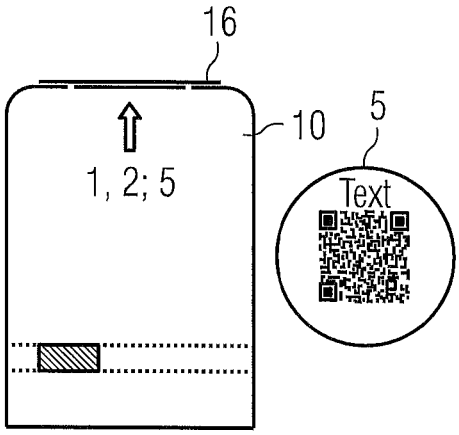
Figure 21C:
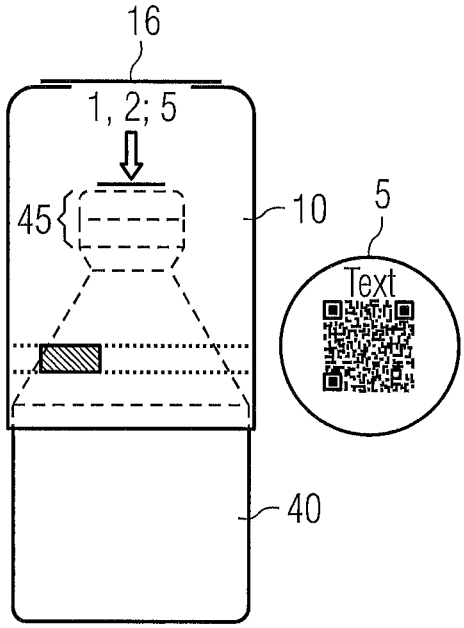
Figure 21D:
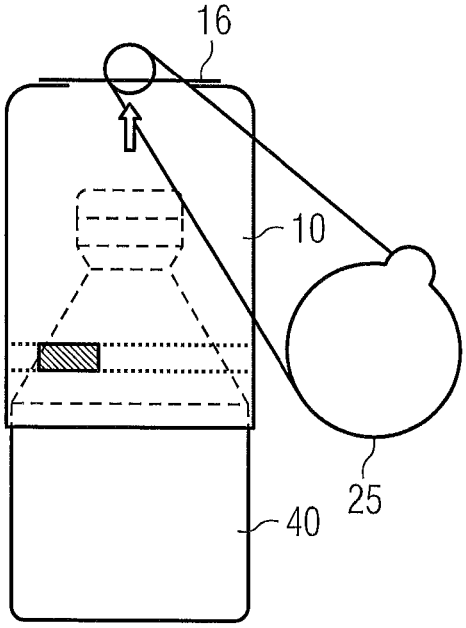

FIG. 21A shows a closure capsule 10 which has, instead of the lateral area, its end face 16 (axial end; lid face; head area etc.) provided with an identification feature, say an electronically storing identification feature (RFID chip 1 plus antenna 2) or a visual ID code 5. Nevertheless, a further identification feature may be provided in addition on the lateral area or on the label. The end face 16 can also be provided with other letterings 19. According to FIG. 21B, the respective identification feature is not arranged on the outer side, but on the inner side of the end face 16 of the closure capsule 10. This has the advantage that the respective identification feature is visible only after having opened or torn off the closure capsule 10, so that the user is able to read and scan the identification feature under the end face 16 only after having opened and destroyed the closure element. This means that the authorization to gain access to certain information or programs does still not exist for a person who has already opened the closure element. FIG. 21C shows a third variant in which the further identification feature is arranged on a receptacle cap 45 (plug, cap or other lid) of the receptacle 40. In particular with this embodiment, the closure capsule 10 may be opaque at least in parts, for instance at its end face, to prevent the reading process before removal of the closure element. FIG. 21D shows a shield element 25 which may be arranged on the end face 16 of the closure capsule 10, to cover an RFID chip 1 or an antenna 2, a visual ID code 5 or any other identification feature at least temporarily. Instead of an electrically conductive, i.e. screening shield element 25, a non-transparent covering, for instance another overlay label for covering a lettering or a visual ID code may be provided at the same place. Basically, all embodiments of this application allow the provision of identification features or other tamper-evidence means at the same time (in particular in combination with one another), such as an RFID chip 1 in addition to a visual ID code 5 or other visual (or also electronic) marking means. It is also possible to make provision for three or more of such identification or marking means, for instance one or more of them on, in, beneath or on top of the lateral area of the receptacle or the label, one on a head end or end face of the receptacle and/or another one (possibly surrounded by the closure capsule) on the receptacle or its receptacle cap. Incidentally, in all embodiments of this application it is possible to provide a separate shielding capsule or cap (such as a metal foil capsule) in addition to an inner closure capsule (which may be made of plastic or a foil), resulting in a double capsule. For the purpose of fully or partly covering visual Information, a void foil or another, preferably opaque (colored) covering foil may be provided as well.

Figure 22A:
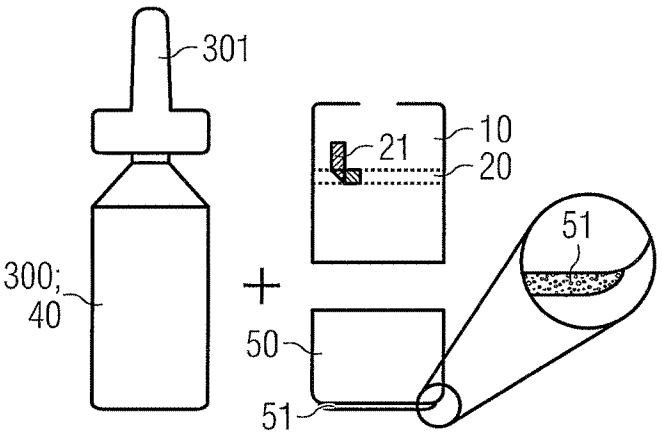
Figure 22B:
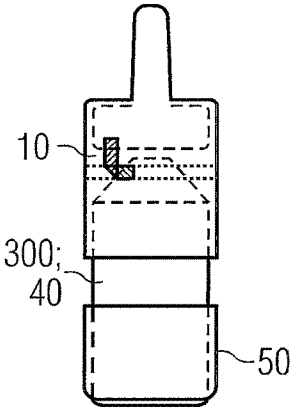
Figure 22C:
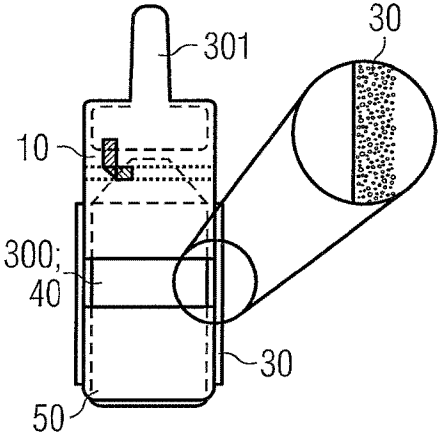
Figure 22D:
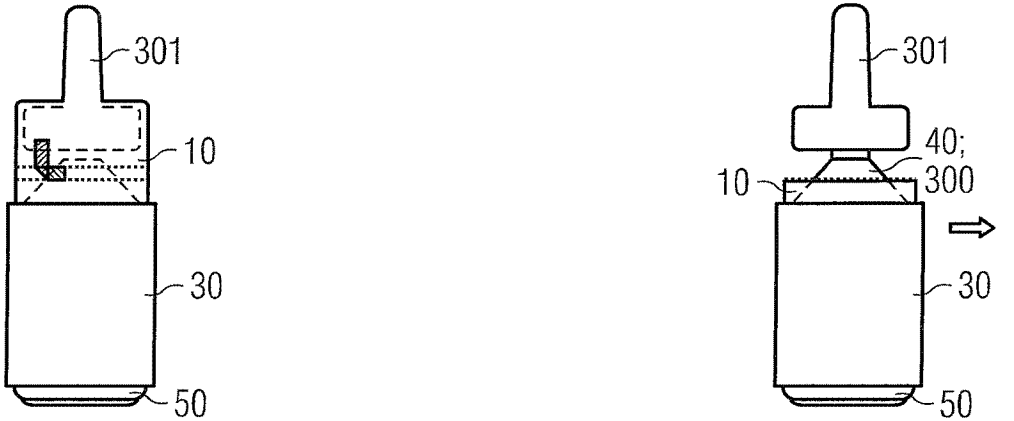
Figure 22E:
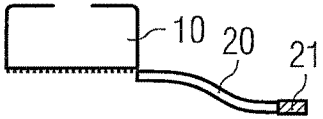

FIGS. 22A to 22E show a further development in which the closure element 10 additionally comprises a further closure capsule 50 which is arranged on the opposite end (for instance a bottom end of a spray bottle 300 or another receptacle 40) and surrounds it. For preventing the breakage of the glass of the spray bottle, a foam layer 51 or another shock-absorbing layer (or a suitable fluting such as in FIG. 17H) may be provided above or underneath the bottom area of the closure capsule 50; same applies to the other surfaces of the respective closure capsules of FIGS. 22A to 22E as well as the closure capsule of the other embodiments of this application. FIG. 22B shows the arrangement of the spray bottle 300 between the two closure capsules 10, 50. FIG. 22C shows the overall arrangement in which the label 30 connects the two closure capsules to each other, whereby the receptacle is reliably enclosed. The label 30 itself may also comprise a shock-absorbing layer. In a middle area between the two closure capsules 10, 20, the label 30 is bonded to the receptacle (not shown for clarity) preferably in an adhesive fashion. FIG. 22D shows the same assembly as in FIG. 22C, but in a side view instead of a cross-sectional view. FIG. 22E shows the assembly after having opened and torn off the tear strip 20, whereby an upper part of the closure capsule 10 is severed and removed. Hereby, the web of the spray head 310 is exposed to be able to take out the spray bottle 301 and use it.

The exemplary embodiments of the present application offer an effective tamper-evidence feature and an effective copy protection. In the process of opening the closure element, not only the receptacle becomes accessible, but also the closure element, in particular its label and possibly an identification feature (such as an RFID chip comprising an antenna and/or a visual ID code; possibly a void area or a closure seal as well) are visibly and irreversibly destroyed and rendered unusable. Further, the electronic (or in other respects visual) coding of the individual receptacle and its visual or electronic identification function will be irreversibly destroyed.

It is not absolutely necessary that the closure element for the receptacle surrounds the major part of the circumference of the receptacle (such as illustrated in FIG. 7B or on the drawing sheets depicting FIGS. 15A to 19E and 21A to 22E). Instead, the closure element (in particular the one of the exemplary embodiments of FIGS. 15A to 19E and 21A to 22E) may be modified to the effect that it encloses merely a receptacle portion having a smaller circumference. Then, the closure element is to be fastened (by means of its closure label) to said narrow receptacle portion.

The closure element may be provided or shaped for a receptacle which tapers toward the upper end, for instance, and is configured as in FIGS. 7A, 8A to 8C or 10. In particular, the receptacle may comprise an opening area or head area or bottleneck 43 which has a smaller radius and perimeter than another (preferably lower) part of the receptacle, for instance a belly of the bottle (such as the bottle body 44) which is wide enough for circumferentially surrounding the actual content of the receptacle (usually a liquid). The head area (or opening area or bottleneck 43) of the receptacle, however, may have an outer circumference which is smaller than the outer circumference (and preferably also smaller than the inner circumference) of the circumferential outer wall of the belly of the receptacle. The diameter and/or circumference (in particular the inner circumference) of the closure capsule described in the present application may be dimensioned so as to be conformed to the diameter and/or circumference (in particular the outer circumference) of the receptacle. The closure element can then be attached to the head area of the receptacle without the need that the belly of the receptacle has to be covered or overlapped by the closure element; the belly of the receptacle is exposed after having attached the closure element.

The closure element may be further designed for being affixed to a receptacle comprising a transition zone in which the diameter of the receptacle or the outer circumference of the receptacle increases from the diameter/circumference of the neck of the receptacle to the diameter/circumference of the belly of the receptacle. The closure label may be especially designed for being attached to the transition zone (instead of the head area), in particular for being affixed thereto in adhesive fashion. In this case, a lower or peripheral part of the label surface (alternatively or additionally even a lower part of the closure capsule itself; cf. FIG. 12) may be provided with weakening lines 15 or other predetermined breaking structures. These predetermined breaking structures may be formed in particular on a lower edge of the closure label and/or of the closure capsule. The closure label of the closure element may be designed for being adhesively affixed to the head area or opening area or neck of the receptacle (as in FIGS. 7A, 8A to 8C and 10), to the transition zone or to both the neck of the receptacle and the transition zone. Above all, the exemplary embodiments of FIGS. 15A to 19E and 21A to 22E can be modified with respect to the variants mentioned above.

As shown by FIGS. 7A and 7B, the closure element can be selectively attached to the opening area or the largest circumference of the receptacle, also those exemplary embodiments (in which the closure element is illustrated as being attached to the opening area) can be modified to the effect that the closure element is designed for being attached to the largest outer circumference, in particular to the belly of the receptacle. By way of example, the additional material layer exemplarily discussed on the basis of FIG. 10 may also be provided in the exemplary embodiments of FIGS. 15A to 19E and 21A to 22E, in fact preferably between the outer circumference of the receptacle's belly and the inner area of the closure label. The additional material layer 30 may also be provided with the above-mentioned modifications of those Figures in which the closure element is attached to the opening area and not to the belly of the receptacle. Similarly, the exemplary embodiments of FIGS. 1 to 3E and 5 to 14 can be transferred to those of FIGS. 15A to 22E, and vice versa.

It is preferred that the tear strip is an integral part of the closure capsule, i.e. it forms a part of a one-piece molded part (preferably made of plastic), together forming the closure capsule and the tear strip. Thus, the tear strip 20 forms a material part which—at least until being torn open or torn off—is connected to a larger and preferably somewhat more solid part of the closure capsule 10 at least in parts along the entire portion or at least major portion of the outer circumference.

Moreover, the closure element of the exemplary embodiments of the application is preferably designed such that the label is severed and destroyed in the course of pulling the tear strip; in particular in such a manner that one or even more, preferably several different identification features such as an RFID chip, an antenna for an RFID chip and/or a visual ID code (such as a QR code) are severed, damaged or otherwise made unusable and/or altered. Accordingly, at least the closure label is destroyed during pulling the tear strip, or is irreversibly damaged at least to such an extent that the attempt of re-establishment or an unauthorized reuse is readily identifiable.

Finally, the tear strip may be designed in all embodiments as a tear-off strip, i.e. be connected to the remaining part of the closure capsule 10 such that it is usually completely torn off when it is pulled.

LIST OF REFERENCE NUMERALS

1 RFID chip
2; 2A, 2B, 2C antenna
3 circumferential area
5 visual ID code
10 closure capsule
11 upper end
12 lower end
13 lateral area
14 edge line
15 weakening line
16 end face
17 fluting
18 groove
19 lettering
20 tear strip
21 grip tab
22 section
23 separating line
24 void area
25 shield element
26 overlay label
30 label
31 substrate
31A lower side
32 adhesive
33 material layer
34 punched zone
35 weakening line
36 lower area
37 recess
38 first subarea
39 second subarea
40 receptacle
41 opening
42 seal
43 bottleneck
44 bottle body
45 receptacle cap
50 further closure capsule
51 foam layer
100 stamp
300 spray bottle
301 spray head
400 injection syringe
401 injection needle
d1, d2 thickness

The invention claimed is:

1. A closure element for a receptacle holding a pharmaceutical content, comprising:
- a closure capsule comprising a lateral area, a closed end and an open end,
- a tear strip comprising a grip tab for opening the closure capsule and
- a closure label comprising a web-shaped substrate which has a lower side provided with an adhesive;
- wherein the closure capsule is arranged on the receptacle in such a way that the closure capsule covers an opening of the receptacle,
- wherein the tear strip is configured as a separate part,
- wherein the closure label is arranged on the receptacle and on the closure capsule, and
- wherein the tear strip, when being pulled, severs and destroys the closure capsule but not the closure label.

2. The closure element according to claim 1, wherein the closure capsule is rotationally symmetrical.

3. The closure element according to claim 1, wherein the tear strip extends in the circumferential direction along the lateral area of the closure capsule.

4. The closure element according to claim 1, wherein the tear strip extends parallel to an axis of symmetry of the closure capsule.

5. The closure element according to claim 1, wherein the closure label comprises weakening lines, and wherein at least some of the weakening lines provide for an exact crack formation through the closure label when the tear strip is about to be pulled.

6. The closure element according to claim 1, wherein the grip tab of the tear strip is exposed in a region of a recess or any other cutout of the label.

7. The closure element according to claim 1, wherein the grip tab of the tear strip is folded over or angled in another way and therefore extends along an axis of symmetry of the closure capsule in exposed manner, whereas a major part of the tear strip extends in azimuthal fashion along the lateral area of the closure capsule.

8. The closure element according to claim 1, wherein the label comprises an additional material layer having a predetermined thickness.

9. The closure element according to claim 8, wherein the thickness of the additional material layer corresponds approximately to a thickness of the lateral area of the closure capsule.

10. The closure element according to claim 1, wherein the closure element comprises an RFID chip.

11. The closure element according to claim 10, wherein the RFID chip is applied on or under the label or is worked into the material thereof and is positioned by the label in a region of the lateral area of the closure capsule or of the circumferential area of the receptacle.

12. The closure element according to claim 10, wherein an antenna is connected to the RFID chip, said antenna being applied on or under the label or worked into the material thereof.

13. The closure element according to claim 12, wherein the antenna extends within the base area of the web-shaped substrate of the label in such a manner that it surrounds the RFID chip in spiral fashion.

14. The closure element according to claim 12, wherein the antenna extends on, in or under the label in such a manner that it overlaps the tear strip in parts and is destroyed when the tear strip is pulled.

15. The closure element according to claim 12, wherein an individual identification code is stored or can be stored in the RFID chip, which can be read out as long as the antenna is not destroyed.

16. The closure element according to claim 12, wherein the RFID chip and the antenna are arranged in a severable section, where the tear-off section can still be used if it has been severed from the remaining portion, in particular can be adhesively affixed to another object.

17. The closure element according to claim 16, wherein the antenna passes through a separating line between the severable section and the remaining label, whereby the antenna is destroyed during severing the severable section.

18. The closure element according to claim 10, wherein several antennas are connected to the RFID chip, at least one antenna being arranged such that it is destroyed when the tear strip is pulled, whereas at least one further antenna is arranged such that it remains intact when the tear strip is pulled and then allows at least a limited communication such as the occasion of partial functions of the RFID chip or the readout of partial information from the RFID chip.

19. The closure element according to claim 10, wherein the label comprises a two-dimensional, electrically conductive and removable shield element which covers the RFID chip and the antenna and allows a communication with the RFID chip only when it has been removed from the RFID chip and the antenna.

20. The closure element according to claim 19, wherein the shield element is an overlay label covering a surface area of the label, the RFID chip and the antenna being arranged in or under or on said surface area.

21. The closure element according to claim 19, wherein the label is a multi-wraparound label extending around the lateral area of the closure capsule more than once, and wherein the shield element is arranged in a surface section associated to the multi-wraparound label and covering at least one of the RFID chip and the antenna, wherein at least one of the RFID chip and the antenna is arranged on at least one of the lateral area of the closure capsule and the circumferential area of the receptacle, but the label is peeled off from at least one of the RFID chip and the antenna when the label is being partially opened.

22. The closure element according to claim 20, wherein at least one of the label and the overlay label is provided with a void area, the void area irreversibly making visible a process of at least partially opening the label for the first time or peeling off the overlay label from the remaining label prior to or during exposing the RFID chip or the antenna underneath the shield element.

23. The closure element according to claim 10, wherein the RFID chip is arranged outside or inside on an end face of the closure capsule surrounded by the lateral area.

24. The closure element according to claim 1, wherein the closure element comprises an encrypted visual ID code.

25. The closure element according to claim 24, wherein the visual ID code holds access information on the communication with the RFID chip.

26. The closure element according to claim 24, wherein the visual ID code is arranged on the label or on a lateral area of the closure capsule in such a position that it is destroyed when the tear strip is pulled.

27. The closure element according to claim 24, wherein the ID code is arranged outside or inside on an end face of the closure capsule surrounded by the lateral area.

28. The closure element according to claim 1, wherein the closure capsule has its lateral area provided with a fluting enhancing the torsional stiffness of the lateral area.

29. The closure element according to claim 1, wherein the closure capsule, on the inner side of the lateral area, comprises at least in parts a groove pointing inwards and having a smaller inner diameter than the cylindrical portion.

30. The closure element according to claim 1, wherein the closure capsule is made from a plastic foil.

31. The closure element according to claim 1, wherein the closure element comprises a further closure capsule which is connected to the label.

32. The closure element according to claim 31, wherein at least one of the two closure capsules comprises a shock-absorbing plastic layer on a bottom area or end face.

33. A receptacle holding a pharmaceutical content and provided with a closure element according to claim 1.

34. The receptacle according to claim 33, wherein the receptacle comprises a bottleneck and the label is attached to the bottleneck.

35. The receptacle according to claim 33, wherein the receptacle comprises a bottleneck and a bottle body and the label is attached to the bottle body.

36. The receptacle according to claim 33, wherein the receptacle is a spray bottle or an injection syringe.

37. The receptacle according to claim 36, wherein the closure capsule is attached to the circumferential area of the spray bottle or on the circumferential area of a syringe body of the injection syringe by the label.

38. The receptacle according to claim 36, wherein the closure capsule encloses and protects a spray head of the spray bottle and its protection cap or an injection needle of the injection syringe and its protection cap in the axial direction.

39. The receptacle according to claim 36, wherein the receptacle is a spray bottle, the closure capsule surrounding at least one of an annular web of the spray head and a dedicated protection cap in the circumferential direction and safeguarding it in the axial direction, and the closure capsule comprising an internal opening through which an elongated spray channel duct of the spray head or of its protection cap protrudes in the axial direction.

40. The receptacle according to claim 33, wherein the receptacle is a vial or an ampoule, a supply bottle, a pill bottle or any other bottle holding a pharmaceutical content or provided for a pharmaceutical content.

41. The receptacle according to claim 33, wherein the receptacle comprises a receptacle cap which is surrounded by the closure capsule of the closure element, a groove of the closure capsule encompassing the receptacle cap of the receptacle.

42. The receptacle according to claim 33, wherein the receptacle comprises a receptacle cap and an RFID chip or a visual ID code being arranged on a head end of the receptacle cap.

43. An assembly comprising:

a receptacle for holding a pharmaceutical content, wherein the receptacle comprises an opening fitted with a receptacle cap, and a closure element for the receptacle, wherein the closure element comprises:

a closure capsule comprising a lateral area, a closed end and an open end, a tear strip comprising a grip tab for opening the closure capsule and a closure label comprising a web-shaped substrate which has a lower side provided with an adhesive;

wherein the closure capsule is arranged on the receptacle in such a way that the closure capsule covers the receptacle cap of the receptacle, and wherein a first subarea of the closure label is arranged on the receptacle and a second subarea of the closure label is arranged on the closure capsule and the tear strip in such a way that the grip tab of the tear strip is not covered by the closure label.

44. The closure element according to claim 1, wherein the tear strip is arranged laterally offset in an axial direction of the closure element or of the receptacle, with respect to the closure label.

* * * * *